US009945202B1

(12) United States Patent
June et al.

(10) Patent No.: US 9,945,202 B1
(45) Date of Patent: Apr. 17, 2018

(54) PROTECTED ANNULUS FLOW ARRANGEMENT FOR SUBSEA COMPLETION SYSTEM

(71) Applicant: OneSubsea IP UK Limited, London (GB)

(72) Inventors: David June, Houston, TX (US); Claudio Santilli, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/470,099

(22) Filed: Mar. 27, 2017

(51) Int. Cl.
*E21B 33/035* (2006.01)
*E21B 33/043* (2006.01)
*E21B 33/04* (2006.01)

(52) U.S. Cl.
CPC ..... *E21B 33/035* (2013.01); *E21B 33/043* (2013.01); *E21B 33/04* (2013.01)

(58) Field of Classification Search
CPC ..... E21B 33/035; E21B 33/043; E21B 33/04
USPC ..... 166/368
See application file for complete search history.

(56) References Cited

U.S. PATENT DOCUMENTS 6,050,339 A * 4/2000 Milberger ..... E21B 33/035 166/348
6,062,314 A * 5/2000 Nobileau ..... A61C 13/0003 166/368
6,357,529 B1 * 3/2002 Kent ..... E21B 33/035 166/344
6,715,554 B1 4/2004 Cunningham et al.
7,025,132 B2 * 4/2006 Kent ..... E21B 33/0355 166/368
8,157,015 B2 * 4/2012 Voss ..... E21B 33/0355 166/344
8,590,625 B1 * 11/2013 Smith ..... E21B 33/0385 166/344
2003/0089501 A1 * 5/2003 Hartmann ..... E21B 33/035 166/348

* cited by examiner

*Primary Examiner* — James G Sayre
(74) *Attorney, Agent, or Firm* — Rodney Warfford; Bob Van Someren

(57) ABSTRACT

A technique facilitates protection of potentially susceptible components from unwanted exposure to well fluids or other fluids in a monobore subsea installation. The subsea installation may comprise various components, e.g. a tubing hanger and a subsea tree which form a plenum region therebetween. An annulus stab (or stabs) is positioned to extend between the tubing hanger and the subsea tree so as to provide an isolated flow path within the annulus stab and through the plenum region. The isolated flow path also may extend longitudinally through the tubing hanger until exiting through a side of the tubing hanger. The annulus stab and overall isolated flow path are thus able to accommodate an annulus flow within the monobore subsea installation while protecting components exposed to the plenum region from contact with deleterious fluids in the annulus flow path.

18 Claims, 3 Drawing Sheets

PROTECTED ANNULUS FLOW ARRANGEMENT FOR SUBSEA COMPLETION SYSTEM

BACKGROUND

Hydrocarbon fluids such as oil and natural gas are obtained from a subterranean geologic formation, referred to as a reservoir, by drilling a well that penetrates the hydrocarbon-bearing geologic formation. In subsea applications, the well is drilled at a subsea location and the flow of fluids may be handled by several different types of equipment. In subsea operations, for example, subsea equipment may comprise subsea completion systems which may include or work in cooperation with subsea installations mounted over a wellhead. The subsea installations may comprise various components, e.g. tubing hangers and subsea trees, and may incorporate fluid flow paths, e.g a production flow path and an annulus flow path. In a variety of traditional systems, an open plenum exists between a top of the tubing hanger and a bottom of the subsea tree. The annulus flow path effectively extends through the open plenum region but this can expose a variety of components to potentially deleterious well fluids or other fluids.

SUMMARY

In general, a system and methodology are described that protect potentially susceptible components from unwanted exposure to well fluids or other fluids in a monobore subsea installation. The subsea installation may comprise various components, e.g. a tubing hanger and a subsea tree which form a plenum region therebetween. An annulus stab (or stabs) is positioned to extend between the tubing hanger and the subsea tree so as to provide an isolated annulus flow path within the annulus stab and through the plenum region. According to an embodiment, the isolated annulus flow path also is defined, in part, by a passageway extending longitudinally through the tubing hanger until exiting through a side of the tubing hanger. The isolation of the annulus flow path within the monobore subsea installation serves to protect components exposed to the plenum region from contact with deleterious fluids in the annulus flow path.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
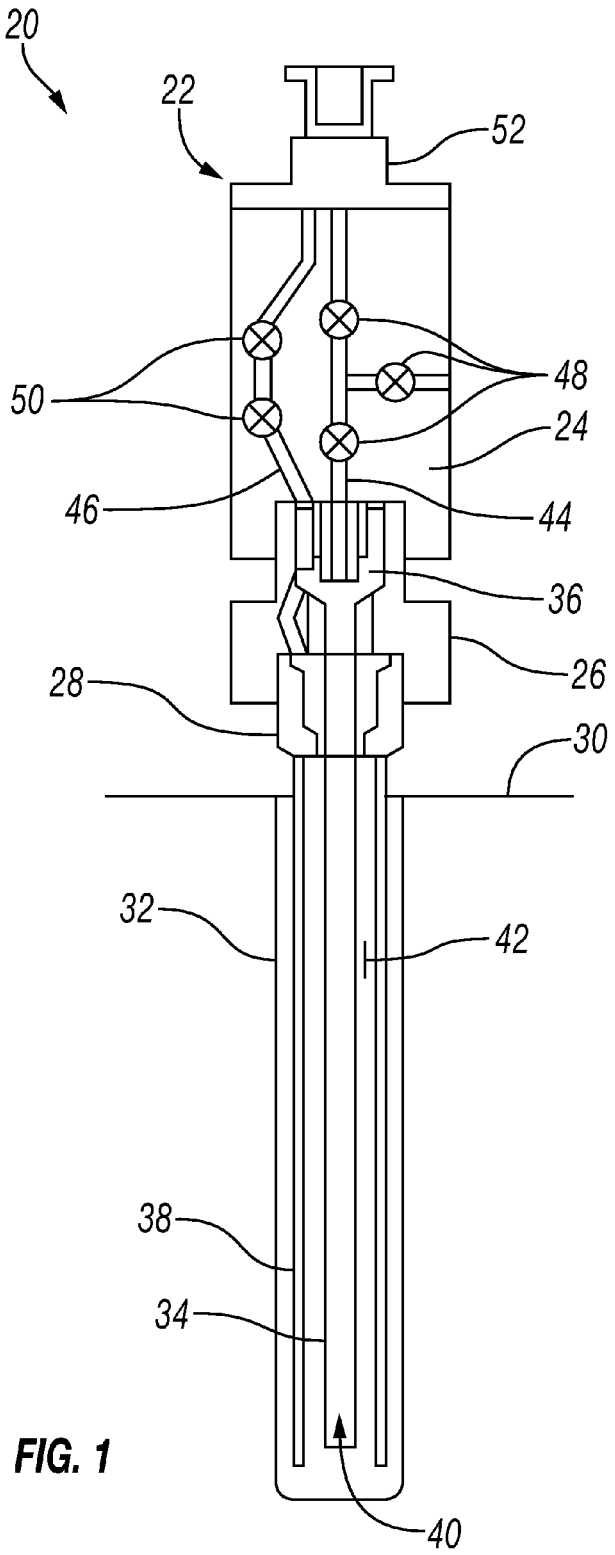
FIG. 1 is a schematic illustration of an example of a well system deployed at a subsea location and comprising a monobore subsea tree, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which are utilized in protecting potentially susceptible components from unwanted exposure to well fluids or other fluids in a monobore subsea installation. The subsea installation may comprise various components which interface with each other, e.g. a tubing hanger and a subsea tree which form a plenum region therebetween. Depending on the application, the tubing hanger also may form an interface with other components such as a tubing hanger running tool. A production path and an annulus path are routed through the subsea installation which may have a subsea tree with a monobore configuration. For purpose of explanation, a vertical monobore subsea tree has a central production bore through the subsea tree rather than a production bore at a radially offset position as found in dual bore subsea trees.

According to an example, an annulus stab may be positioned to extend between the tubing hanger and the interfacing component, e.g. subsea tree, so as to provide an isolated flow path within the annulus stab and through the plenum region. The isolated annulus flow path also is defined, in part, by a passageway extending longitudinally through the tubing hanger until exiting through a side of the tubing hanger. The isolation of the annulus flow path within the monobore subsea installation serves to protect components exposed to the plenum region from contact with deleterious fluids in the annulus flow path. In some embodiments, the annulus flow path may utilize a plurality of flow passages combined with a plurality of corresponding annulus stabs.

For example, a vertical monobore subsea tree configuration may be configured with a central production bore which provides a production flow path. The annulus flow path may be provided by two or more smaller annulus stabs selected to achieve a desired flow area. By way of example, the annulus stabs may be located on the same centerline and bolt circle as hydraulic and electric couplers in a given vertical monobore subsea tree. This approach may be used to provide better deflection characteristics throughout the body of the subsea tree when high pressure is applied to the production bore and/or production stabs.

The subsea installation also comprises a tubing hanger which may have a tubing hanger body with two or more holes extending from the annulus stabs and intersecting a passage, e.g. a lateral passage. By way of example, each lateral passage may be oriented to extend to an outside diameter of the tubing hanger for alignment with an opening or hole along the inside diameter of a tubing head spool assembly. Appropriate seals may be used to seal off these passages above and below their aligned connection and communication point. The joint passages are thus arranged to facilitate annulus flow. According to an embodiment, the tubing head spool annulus passage may be routed to one or more valves located inside or outside of a tubing spool body. Additionally, another annulus passage may be routed through the tubing head spool from an opposite side of the valve(s) to a well annulus.

Referring generally to FIG. 1, an example of a subsea well system 20 for use in a well operation is illustrated. The subsea well system 20 may comprise a subsea installation 22, e.g. a monobore subsea installation. The subsea installation 22 may have a variety of components, such as a subsea tree 24, e.g. a vertical monobore subsea tree, mounted on a tubing head spool 26 positioned over a wellhead 28 at a subsea surface/mudline 30. The wellhead 28 may be positioned over a well 32 in which production tubing 34 is suspended from a tubing hanger 36 located at tubing head spool 26.

In the illustrated example, the production tubing 34 and a well casing 38 establish flow passages, such as a subsurface production flow passage 40 and an annulus flow passage 42. According to an embodiment, the production flow passage 40 and the annulus flow passage 42 are continued up through tubing head spool 26, tubing hanger 36, and subsea tree 24 via a subsea installation production flow passage 44 and a subsea installation annulus flow passage 46, respectively. Depending on the embodiment, the flow passages may be split into a plurality of passages. For example, the annulus flow passage 46 may comprise a plurality of flow passages arranged around a centrally located production passage 44.

Regardless, the passages 44, 46 provide desired flow paths and flow capacities through the tubing head spool 26, tubing hanger 36, and subsea tree 24. Fluid flow along production flow passage 44 and annulus flow passage 46 may be controlled by production valve(s) 48 and annulus valve(s) 50, respectively. By way of example, valves 48, 50 may comprise production gate valves and annulus gate valves. In the embodiment illustrated, the subsea well system 20 also comprises a tree cap 52 which may be releasably deployed into engagement with the subsea tree 24.

According to an embodiment, the annulus flow passage 42 is between the production tubing 34 and well casing 38 and is concentrically located about the production flow passage 40 within production tubing 34. Production fluid is able to flow up through production tubing 34 and continue through the subsea installation 22 along installation production flow passage 44 as controlled via valves 48. The installation annulus flow passage 46 is in communication with the annulus between production tubing 34 and well casing 38 to allow annular flow as controlled via valves 50.

Figure 2:
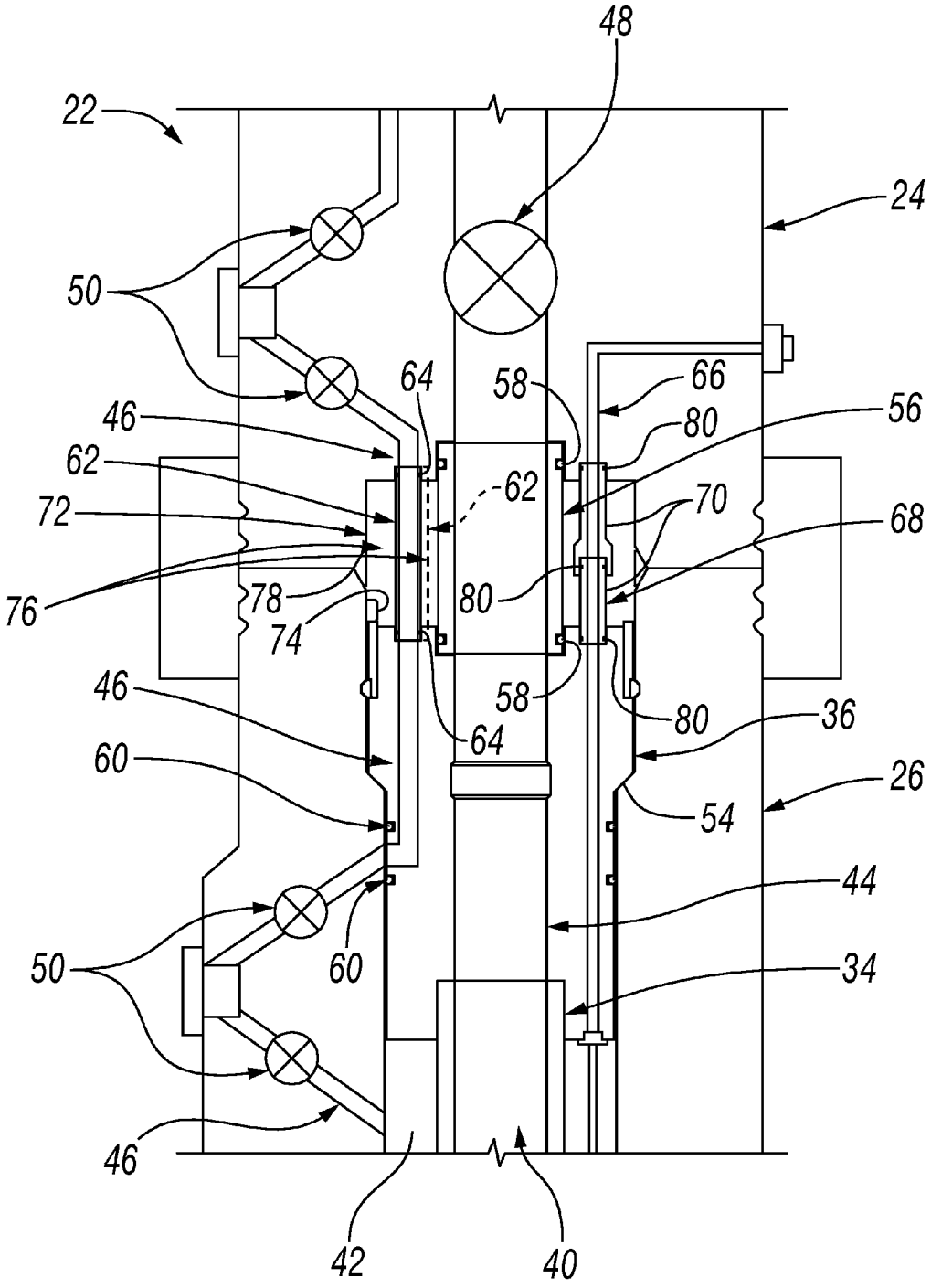
FIG. 2 is a cross-sectional illustration of a portion of a subsea installation showing an embodiment of a subsea tree interfaced with a tubing hanger and having a production path and an annulus path routed through the subsea installation, according to an embodiment of the disclosure.

Referring generally to FIG. 2, an embodiment of the subsea installation 22 is illustrated in which subsea tree 24 is mounted on tubing head spool 26 and tubing hanger 36 is suspended in the tubing head spool 26 via an abutment 54. In this example, the installation production flow passage 44 extends generally along a center line of the tubing head spool 26, tubing hanger 36, and subsea tree 24 (a monobore configuration). Fluid communication along flow passage 44 between tubing hanger 36 and subsea tree 24 may be enabled via a production stab 56. As illustrated, the production stab 56 may be sealed with respect to inside surfaces of the tubing hanger 36 and the subsea tree 24 via appropriate seals 58, e.g. O-ring seals or other suitable seals. The production stab 56 also facilitates coupling and decoupling of the subsea tree 24 with respect to the tubing hanger 36 when the subsea tree 24 is mounted on tubing head spool 26 or removed from tubing head spool 26, respectively.

In this example, the installation annulus flow passage 46 is placed in communication with the annulus between production tubing 34 and well casing 38 at tubing head spool 26. As illustrated, the flow passage 46 is routed along the tubing head spool 26 and through an annulus valve or valves 50, e.g. a pair of annulus valves 50, before entering tubing hanger 36 through, for example, a side of the tubing hanger 36. Appropriate seals 60, e.g. O-ring seals or other suitable seals, may be positioned between an exterior surface of tubing hanger 36 and an interior surface of tubing head spool 26 to ensure a sealed annular flow passage between tubing head spool 26 and tubing hanger 36.

Fluid communication along flow passage 46 between tubing hanger 36 and subsea tree 24 may be enabled via an annulus stab 62. As illustrated, the annulus stab 62 may be sealed with respect to inside surfaces of the tubing hanger 36 and the subsea tree 24 via appropriate seals 64, e.g. O-ring seals or other suitable seals. The annulus stab 62 further facilitates coupling and decoupling of the subsea tree 24 with respect to the tubing hanger 36 when the subsea tree 24 is mounted on tubing head spool 26 or removed from tubing head spool 26, respectively. The stabs 56, 62 may be in the form of tubing sections or other suitable structures which extend between the sections of the annulus flow passage 46 in the tubing hanger 36 and in the subsea tree 24. In the example illustrated, the portion of annulus flow passage 46 in subsea tree 24 is routed through the subsea tree 24 from a bottom to a top of the subsea tree 24.

In some applications, the annulus valves 50, e.g. gate valves, may be appropriately actuated, e.g. opened, to enable fluids to be directed down through the installation annulus flow passage 46. In this situation, the fluid is directed through subsea tree 24 and into tubing hanger 36 via annulus stab(s) 62 before being directed radially outward through a side of the tubing hanger 36 and into the corresponding portion of flow passage 46 which extends through tubing head spool 26. From tubing head spool 26, the passage(s) 46 enables fluid flow down into the annulus between production tubing 34 and well casing 38. In some operations, fluid also may be directed or allowed to flow in the opposite direction along the installation annulus flow passage 46. According to the illustrated embodiment, the annulus flow passage(s) 46 in tubing hanger 36 extends longitudinally within a wall of tubing hanger 36 and then makes a generally right-hand turn to a lateral passage section before exiting through a side of the tubing hanger 36 between seals 60. However, the annulus flow passage(s) 46 may be located along different routes within the tubing hanger 36 and may extend through the side of the tubing hanger 36 via lateral passage sections oriented at various desired angles with respect to the intersected linear/longitudinal passage sections.

It should be noted the installation annulus flow passage 46 may comprise a plurality of passages. By way of example, the plurality of passages forming flow passage 46 may be disposed about the production flow passage 44. A plurality of corresponding annulus stabs 62, e.g. two annulus stabs, may be positioned along the plurality of passages, e.g. two passages, forming the annulus flow passage 46 between the tubing hanger 36 and subsea tree 24. In the example illustrated, the flow passage 46 is routed through subsea tree 24 and through an annulus valve or valves 50, e.g. a pair of annulus valves 50. Depending on the application, appropriate arrangements of production valves 48 also may be located in subsea tree 24.

In the embodiment illustrated, one or more control lines 66, e.g. hydraulic, electrical, fiber-optic, or other types of control lines, also may be routed through subsea installation 22. As illustrated, the control line(s) 66 may be routed through components of the subsea installation such as the subsea tree 24, tubing hanger 36, and tubing head spool 26. Appropriate couplers 68 may be used for joining sections of each control line 66 to facilitate coupling and decoupling of adjacent subsea installation components. In the example illustrated, couplers 68 comprises a pair of mating connectors 70, e.g. wet mate connectors, which are passively coupled or decoupled when the subsea tree 24 is mounted on tubing head spool 26 or removed from tubing head spool 26, respectively.

The use of stabs such as production stab 56 and annulus stabs 62 provides a protected flow path for well fluids through a plenum region 72. Various components 74, e.g. sensors, electronics, seals, and other components susceptible to the deleterious effects well fluid, may be positioned in or along the plenum region 72. The stabs, e.g. stabs 56, 62, provide isolation and protection for these components 74 by containing both the production flow and annulus flow of fluids along the interior of subsea installation 22.

Because of the annulus stab or stabs 62, a gallery area 76 is formed in the plenum region 72. The gallery area 76 may be defined as the space below subsea tree 24 and above tubing hanger 36. The gallery area 76 also may be defined radially as the area between production stab 56 and a gasket 78 which is positioned between the subsea tree 24 and the tubing hanger 36. Once the stabs 56, 62 are properly sealed in place, this gallery area 76 is no longer part of the annulus fluid flow path and is protected from exposure to well fluids flowing along the annulus fluid flow path within passage(s) 46.

According to an embodiment, valves or other flow control mechanisms may be positioned near the top and near the bottom of the gallery area 76 so as to enable seawater to be circulated out of the gallery area 76 and displaced with a less detrimental fluid with respect to components 74. As a result, at least some of the components 74 (including couplers 68) may be constructed with less expensive materials, less expensive seals, and/or less expensive protective features. For example, couplers 68 may utilize seals 80 which are less expensive, e.g. elastomeric seals rather than metal seals. Because the annulus stabs 62 isolate the flow of annulus fluids, the subsea installation 22 can be constructed without tree isolation sleeves.

Figure 3:
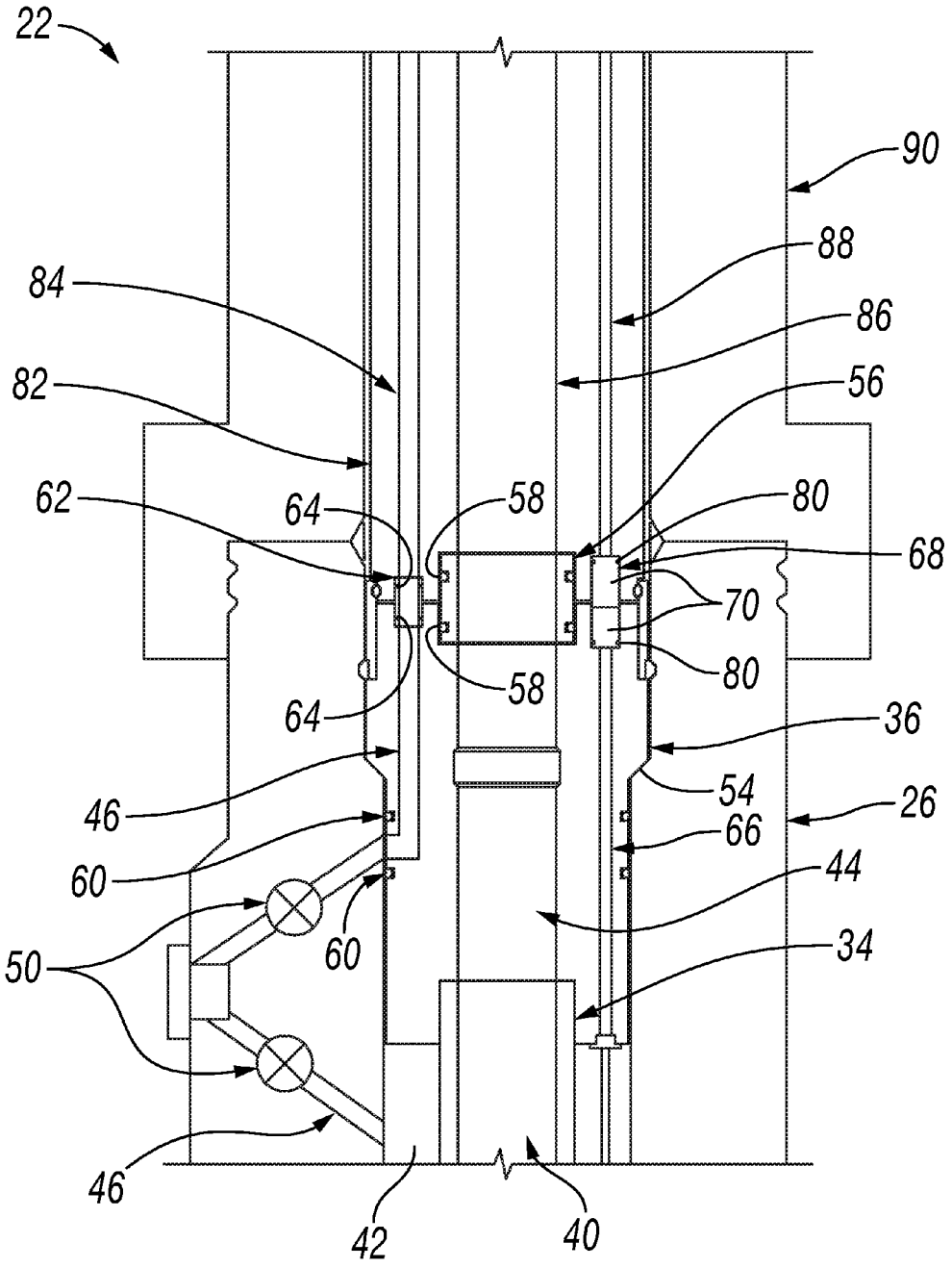
FIG. 3 is a cross-sectional illustration of a portion of a subsea installation showing an embodiment of a tubing hanger running tool interfaced with a tubing hanger and having a production path and an annulus path routed through the subsea installation, according to an embodiment of the disclosure.

Referring generally to FIG. 3, an embodiment is illustrated in which a tubing hanger running tool 82 is positioned on tubing head spool 26 and interfaces with the tubing hanger 36. In this embodiment, the tubing hanger running tool 82 also utilizes the production stab 56 and annulus stabs 62, e.g. two or more annulus stabs, to form a separable interface with the tubing hanger 36. In this manner, an annulus fluid flow along the annulus flow passage 46 may be placed in communication with a corresponding running tool annular passage or passages 84. The passage(s) 84 may be routed longitudinally along the tubing hanger running tool 82.

This type of configuration allows annular flow to be routed through the tubing hanger running tool 82 rather than attempting to route the annulus flow around the outside of the tubing hanger running tool. The tubing hanger running tool 82 also may comprise a running tool production passage 86 and a running tool control line segment or segments 88. As discussed above with reference to FIG. 2 the production stab 56, annulus stab 62, and coupler 68 may be used for operatively coupling the flow paths and communication lines between the tubing hanger running tool 82 and the tubing hanger 36. In the example illustrated, the tubing hanger running tool 82 is routed down through a blowout preventer stack 90, however the running tool 82 may be used in cooperation with a variety of subsea installations 22.

Depending on the specifics of a given well application, the components of subsea tree 24, tubing head spool 26, tubing hanger 36, and/or other components of subsea installation 22 may vary. For example, the subsea tree 22 may comprise various components and arrangements of production passages and annulus passages. In a vertical monobore configuration, various arrangements and numbers of annulus passages may be positioned around a monobore production passage. Additionally, various types of stabs 56, 62 and couplers 68 may be used to facilitate relatively easy coupling and decoupling of the subsea installation components. Furthermore, the tubing hanger running tool 82 may be constructed in various configurations with a variety of components selected according to the parameters of a given subsea operation.

Different embodiments of the subsea installation 22 may comprise plenum regions having gallery areas 76 of many sizes and configurations. The gallery areas 76 may be specifically constructed to facilitate containment of or interaction with many types of components 74. Because the components 74 are protected from the annulus flow of well fluids, additional types of components 74 may be exposed to the gallery area 76. Furthermore, different types of materials and protective features, e.g. less expensive materials and protective features, may be used in constructing components 74 due to the isolation of well fluids along the enclosed installation annulus flow passage 46.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well application, comprising:

a monobore subsea installation having:

a tubing head spool disposed above a wellhead;

a tubing hanger engaged with the tubing head spool;

a subsea tree coupled to the tubing head spool over the tubing hanger and forming a plenum region between the tubing hanger and the subsea tree;

a production stab extending between the tubing hanger and the subsea tree, the production stab being sealed with respect to both the tubing hanger and the subsea tree;

an annulus stab extending between the tubing hanger and the subsea tree to provide an isolated path within the stab and through the plenum region, the isolated path further being routed through the subsea tree, through the annulus stab, and through the tubing hanger until exiting out through a side of the tubing hanger to the tubing head spool to accommodate an annulus flow path along the monobore subsea installation; and a plurality of valves disposed along the isolated path, the plurality of valves comprising at least one valve in the subsea tree along the isolated path and at least one valve in the tubing head spool along the isolated path.

2. The system as recited in claim 1, wherein the annulus stab comprises at least one tubing extending between a tubing hanger annulus flow passage in the tubing hanger and a subsea tree annulus flow passage in the subsea tree.

3. The system as recited in claim 2, wherein the subsea tree annulus flow passage is routed through the subsea tree from a bottom of the subsea tree to a top of the subsea tree.

4. The system as recited in claim 2, wherein the tubing hanger annulus flow passage is routed longitudinally through a wall of the tubing hanger until turning radially outward to the side of the tubing hanger and into a sealed region located in communication with a corresponding annulus flow passage in the tubing head spool.

5. The system as recited in claim 4, wherein the corresponding annulus flow passage is placed in communication with an annulus between a well tubing and a casing extending down below the tubing hanger to form an overall annulus flow passage through the monobore subsea installation.

6. The system as recited in claim 5, further comprising a plurality of valves disposed along the overall annulus flow passage.

7. The system as recited in claim 6, wherein at least two valves of the plurality of valves are disposed along the corresponding annulus flow passage through the tubing head spool.

8. The system as recited in claim 1, wherein the annulus stab comprises a plurality of annulus stabs for conducting flow along the isolated path.

9. A system, comprising:

a subsea installation comprising a tubing hanger and a subsea tree mounted above the tubing hanger and forming a plenum region between the tubing hanger and the subsea tree, the subsea installation comprising a central monobore production passage and an installation annulus passage, the central monobore production passage being defined in part by a production stab extending from the subsea tree to the tubing hanger, the production stab being sealed with respect to both the subsea tree and the tubing hanger, the installation annulus passage being defined in part by an annulus stab extending from the subsea tree to the tubing hanger to isolate annulus flow of well fluid to an interior of the annulus stab, the installation annulus passage being further defined by a tubing hanger annulus flow passage routed through the tubing hanger until exiting out through a side of the tubing hanger to thus protect the plenum region from exposure to the well fluid, the subsea installation further comprising a control line extending through the plenum region and comprising control line sections joined by a pair of mating control line connectors.

10. The system as recited in claim 9, wherein the annulus stab comprises a tube coupled between the subsea tree and the tubing hanger.

11. The system as recited in claim 10, wherein the annulus stab comprises a plurality of annulus stabs.

12. The system as recited in claim 9, wherein the production stab is disposed along a longitudinal center of the subsea installation.

13. The system as recited in claim 9, wherein the annulus stab comprises a tube which extends between the tubing hanger annulus flow passage in the tubing hanger and a subsea tree annulus flow passage within the subsea tree.

14. The system as recited in claim 13, wherein the tubing hanger annulus flow passage is routed longitudinally through a wall of the tubing hanger until turning radially outward to the side of the tubing hanger and into a sealed region located in communication with a corresponding annulus flow passage in a tubing head spool.

15. The system as recited in claim 14, wherein the corresponding annulus flow passage is placed in communication with an annulus between a production tubing and a casing extending down below the tubing hanger to enable an annulus flow through the subsea installation.

16. A method, comprising:

providing a subsea installation with a tubing head spool, a tubing hanger coupled to the tubing head spool, and an interfacing component positioned over the tubing hanger;

positioning the subsea installation over a subsea wellhead at a subsea location;

using a central monobore through the subsea installation for production flow;

enabling an annulus flow along an annulus passage extending through a plenum region between the tubing hanger and the interfacing component;

isolating components in the plenum region from the annulus flow by containing the annulus flow within an annulus stab extending through the plenum region to form a gallery area, of the plenum region, which is no longer part of the annulus flow, the annulus flow further being within a tubing hanger annulus flow passage routed through the tubing hanger until exiting out through a side of the tubing hanger to a tubing head spool; and if seawater is present within the gallery area of the plenum region, displacing the seawater with a different fluid.

17. The method as recited in claim 16, wherein providing comprises providing the interfacing component in the form of a tubing hanger running tool or a subsea tree.

18. The method as recited in claim 16, further comprising using a production stab between the tubing hanger and the interfacing component.

* * * * *